United States Patent [19]

Kingry

[11] 4,239,660

[45] Dec. 16, 1980

[54] DETERGENT COMPOSITION COMPRISING A HYDROLYZABLE CATIONIC SURFACTANT AND SPECIFIC ALKALINITY SOURCE

[75] Inventor: Gary W. Kingry, Nishinomiya, Japan

[73] Assignee: The Procter & Gamble Company, Cincinnati, Ohio

[21] Appl. No.: 969,115

[22] Filed: Dec. 13, 1978

Related U.S. Application Data

[63] Continuation-in-part of Ser. No. 864,135, Dec. 23, 1977, abandoned.

[51] Int. Cl.[3] ..... C11D 1/835; C11D 3/10; C11D 3/04

[52] U.S. Cl. ..... 252/528; 252/547

[58] Field of Search ..... 252/528, 547, 8.8, 117

[56] References Cited

U.S. PATENT DOCUMENTS

| | | | |
|---|---|---|---|
| 2,176,896 | 10/1939 | Epstein et al. | 260/295 |
| 2,459,062 | 1/1949 | Cook et al. | 260/404.5 |
| 2,683,167 | 7/1954 | Girod et al. | 260/482 |
| 3,537,993 | 11/1970 | Coward et al. | 252/8.75 |
| 3,607,763 | 9/1971 | Salmen et al. | 252/547 X |
| 3,959,157 | 5/1976 | Inamorato | 252/8.8 |
| 3,989,711 | 11/1976 | Bobor | 260/309 |
| 4,033,894 | 7/1977 | McLaughlin et al. | 252/99 |
| 4,128,485 | 12/1978 | Bauman et al. | 252/8.8 |

FOREIGN PATENT DOCUMENTS

| | | |
|---|---|---|
| 662170 | 10/1965 | Belgium . |
| 2449501 | 4/1975 | Fed. Rep. of Germany . |

OTHER PUBLICATIONS

Kirk-Othmer, *Encyclopedia of Chemical Technology*, Interscience Publishers, Second Edition, 1964, New York, vol. 3, pp. 617-647.

*Primary Examiner*—Harris A. Pitlick
*Attorney, Agent, or Firm*—Robert B. Aylor; Richard C. Witte; Thomas H. O'Flaherty

[57] ABSTRACT

Laundry detergent compositions offering improved removal of particulate and greasy/oily soils, containing mixtures of selected nonionic and hydrolyzable cationic surfactants, together with specifically defined alkalinity sources, are disclosed. This invention permits the formulation of compositions which are alkaline in the laundry solution, and in which hydrolyzable cationic surfactants are stable during long periods of storage.

32 Claims, No Drawings

DETERGENT COMPOSITION COMPRISING A HYDROLYZABLE CATIONIC SURFACTANT AND SPECIFIC ALKALINITY SOURCE

CROSS-REFERENCE TO RELATED APPLICATION

This application is a continuation-in-part of copending application Ser. No. 864,135, Gary W. Kingry, filed Dec. 23, 1977, now abandoned.

BACKGROUND OF THE INVENTION

This invention relates to storage-stable, alkaline laundry detergent compositions, preferred embodiments of which exhibit excellent particulate and greasy/oily soil removal performance, as well as fabric softening, static control and dye transfer inhibition benefits, to fabrics laundered therewith.

It is taught in U.S. patent application Ser. No. 919,341, Cockrell, filed June 26, 1978, and U.S. patent application Ser. No. 919,181, Murphy, filed June 26, 1978, both of which are incorporated herein by reference, that by selection and combination of specific types of nonionic and cationic surfactants, excellent particulate and greasy/oily soil removal laundering performance can be obtained. In preferred embodiments of those compositions, by choosing specific types of cationic surface-active agents, biodegradable laundry detergent compositions can be formulated which exhibit particulate and grease/oil removal benefits as well as fabric softening, static control, and dye transfer inhibition benefits. Detergent compositions containing these specific biodegradable surfactants are described in U.S. patent application Ser. No. 919,343, Letton, filed June 26, 1978, and U.S. patent application Ser. No. 919,344, Letton, filed June 26, 1978, both of which are incorporated herein by reference.

It is further taught in the above applications that it is desirable that the detergent compositions form alkaline laundry solutions in order to improve the removal of oily body soils. However, because these preferred cationic surfactants contain a biodegradable linkage, such as an ester or amide linkage, they tend to hydrolyze upon storage and use, when included in such alkaline detergent compositions, thereby reducing their effectiveness during the laundering operation. It has now been found that by using the specific types of alkalinity sources defined herein, alkaline detergent compositions may be formulated which minimize the hydrolysis of hydrolyzable linkage-containing cationic surfactants, and particularly the preferred biodegradable cationic surfactants discussed above, during storage and use.

It is, therefore, an object of the present invention to provide alkaline laundry detergent compositions, containing cationic surfactants including hydrolyzable linkages, which are storage-stable.

It is a further object of the present invention to provide laundry detergent compositions which yield excellent removal of particulate and greasy/oily soils, as well as fabric softening, static control, and dye transfer inhibition, to fabrics laundered therewith.

It is a still further object of the present invention to provide laundry detergent compositions, yielding the above cleaning and fabric care benefits, which are biodegradable.

It is yet another object of the present invention to provide a process for laundering fabrics, yielding excellent removal of oily body soils, clay and greasy/oily soils, utilizing detergent compositions which contain selected cationic and nonionic surfactants.

SUMMARY OF THE INVENTION

The present invention relates to storage and wash solution-stable laundry detergent compositions comprising:

(a) from about 2% to about 95% of a cationic surfactant which contains at least one hydrolyzable linkage selected from the group consisting of:

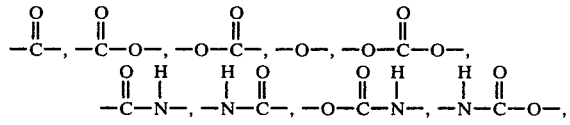

and mixtures thereof; and (b) from about 1% to about 25% of an inorganic alkaline component which is insoluble in said cationic surfactant, and which is present in an amount such that the detergent composition forms a solution having a pH of from about 8 to about 10 within 3 minutes after it is placed in 100° F. water at a concentration of about 0.15%.

A preferred aspect of the present invention encompasses alkaline, laundry detergent compositions, which provide excellent cleaning of particulate and greasy/oily soils, together with a range of fabric care benefits, comprising:

(a) from about 2% to about 95% of a surfactant mixture consisting essentially of:

(1) a nonionic surfactant having an HLB of from about 5 to about 17; and (2) a cationic surfactant selected from the group consisting of:

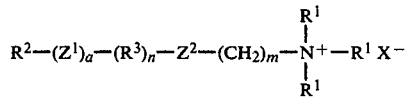

(i)

wherein each $R^1$ is $C_1$ to $C_4$ alkyl or hydroxyalkyl; $R^2$ is $C_5$ to $C_{30}$ straight or branched chain alkyl, alkenyl, alkylbenzyl, or alkyl phenyl group or

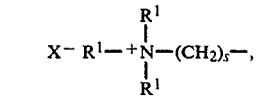

wherein s is from 0 to 5; $R^3$ is $C_1$ to $C_{20}$ alkylene or alkenylene; a is 0 or 1, n is 0 or 1, and a is 1 only when n is 1; m is from 1 to 5; $Z^1$ and $Z^2$ are each selected from the group consisting of:

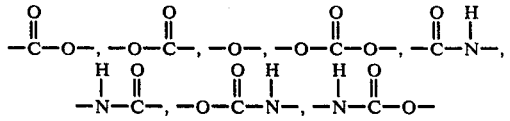

and wherein at least one of said groups is selected from the group consisting of ester, reverse ester, amide and reverse amide; and X is an anion which makes the surfactant at least water-dispersible;

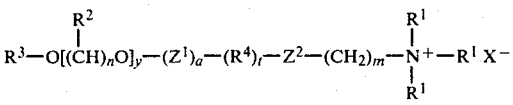

(ii)

wherein each $R^1$ is $C_1$ to $C_4$ alkyl or hydroxyalkyl; each $R^2$ is either hydrogen or $C_1$ to $C_3$ alkyl; $R^3$ is $C_4$ to $C_{30}$ straight or branched chain alkyl, alkenyl or alkylbenzyl; $R^4$ is $C_1$ to $C_{10}$ alkylene or alkenylene; n is from 2 to 4; y is from 1 to 20; a is 0 or 1, t is 0 or 1, and a can be 1 only when t is 1; m is from 1 to 5; $Z^2$ is selected from the group consisting of

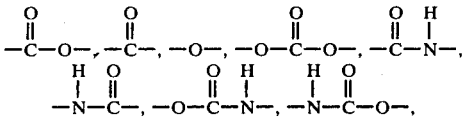

$Z^1$ is selected from the group consisting of

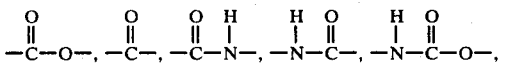

and wherein at least one of said $Z^1$ and $Z^2$ groups is selected from the group consisting of ester, reverse ester, amide, and reverse amide; and X is an anion which makes the surfactant at least water-dispersible; and (iii) mixtures thereof;

wherein the ratio of said nonionic surfactant to said cationic surfactant is in the range of from about 1:1 to about 100:1; and (b) from about 1% to about 25% of an inorganic alkaline component which is insoluble in said cationic/nonionic surfactant mixture, and which is present in an amount such that the detergent composition forms a solution having a pH of from about 8 to about 10 within about 3 minutes after addition to 100° F. at a concentration of about 0.15% by weight.

Preferred nonionic surfactants are biodegradable and have the formula $R(OC_2H_4)_nOH$ wherein R is a primary or secondary alkyl chain of from about 8 to about 22 carbon atoms and n is an average of from about 2 to about 12.

Preferred alkalinity sources for use in the compositions of the present invention include borax pentahydrate, borax decahydrate, sodium carbonate and mixtures of these components. The compositions herein may also contain various optional adjunct materials commonly employed in laundry detergent compositions.

A method of laundering fabrics, yielding the cleaning and fabric care benefits described herein, utilizing the detergent compositions of the present invention, is also taught.

DETAILED DESCRIPTION OF THE INVENTION

The compositions of the present invention contain a hydrolyzable cationic surfactant, or preferably a mixture of selected nonionic and cationic surfactants, together with specific types of inorganic alkalinity-producing components. The compositions contain from about 2% to about 95%, preferably from about 10% to about 90%, and most preferably from about 15% to about 85%, of the cationic or nonionic/cationic surfactant components.

The preferred mixtures are disclosed in detail and claimed in U.S. patent application Ser. Nos. 919,343 and 919,344, Letton, filed June 26, 1978, both of which are incorporated herein by reference, and provide excellent cleaning of particulate and greasy/oily soils, together with a range of fabric care benefits. The specific nonionic and cationic surfactants disclosed therein, and which are also described below, may be combined in ratios of nonionic surfactant to cationic surfactant by weight of from about 1:1 to about 100:1, preferably from about 5:3 to about 50:1, most preferably from about 5:3 to about 20:1. Particularly preferred ratios are from about 5:3 to about 10:1, preferably from about 5:3 to about 5:1, particularly about 5:2. The specific components useful in the compositions of the present invention are described below.

Preferred compositions of the present invention are formulated based on their cloud points and/or reduced cationic monomer concentrations; these concepts are described in detail in U.S. patent application Ser. No. 919,341 Cockrell, filed June 26, 1978 and U.S. patent application Ser. No. 919,181, Murphy, filed June 26, 1978, both of which are incorporated herein by reference. In optimizing greasy/oily soil removal, the compositions should be formulated to have a cloud point of from about 0° to about 95° C., preferably from about 10° to about 70° C., most preferably from about 20° to about 70° C., and a reduced cationic monomer concentration of from about 0.002 to about 0.2, especially from about 0.002 to about 0.15, particularly from about 0.002 to about 0.08. In optimizing particulate soil removal, the compositions should be formulated to have a reduced cationic monomer concentration of from about 0.005 to about 0.2, preferably from about 0.008 to about 0.15, and particularly from about 0.01 to about 0.1.

Nonionic Surfactant

Nonionic surfactants, having an HLB of from about 5 to about 17, well-known in the detergency arts, may be included in the compositions of the present invention together with the cationic surfactants defined hereinafter. They may be used singly or in combination with one or more of the preferred alcohol ethoxylate nonionic surfactants, described below, to form nonionic surfactant mixtures useful in combination with the cationic surfactants. Examples of such surfactants are listed in U.S. Pat. No. 3,717,630, Booth, issued Feb. 20, 1973, and U.S. Pat. No. 3,332,880, Kessler et al, issued July 25, 1967, each of which is incorporated herein by reference. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, di-isobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and di-isooctyl phenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marked by Union Carbide Corporation, Neodol 45-9, marketed by Shell Chemical Company, and Kyro EOB, marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylene diamine. The hydrophobic moiety of these products consists of the reaction product of ethylene diamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

A preferred group of nonionic surfactants useful herein comprises a mixture of "surfactant" and "cosurfactant", containing at least one nonionic surfactant falling within the definition of nonionic surfactants useful in the present invention, as described in U.S. patent application Ser. No. 557,217, Collins, filed Mar. 10, 1975, now abandoned, the disclosure of which is incorporated herein by reference.

Preferred alcohol ethoxylate nonionic surfactants for use in the compositions of the present invention are biodegradable and have the formula $R(OC_2H_4)_nOH$, wherein R is a primary or secondary alkyl chain of from about 8 to about 22, preferably from about 10 to about 20, carbon atoms and n is an average of from about 2 to about 12, particularly from about 2 to about 9. The nonionics have an HLB (hydrophilic-lipophilic balance) of from about 5 to about 17, preferably from about 6 to about 15. HLB is defined in detail in *Nonionic Surfactants*, by M. J. Schick, Marcel Dekker, Inc., 1966, pages 607–613, incorporated herein by reference. In preferred nonionic surfactants, n is from 4 to 7. Primary linear alcohol ethoxylates (e.g., alcohol ethoxylates produced from organic alcohols which contain about 20% 2-methyl branched isomers, commercially available from Shell Chemical Company under the tradename Neodol) are preferred from a performance standpoint.

Particularly preferred nonionic surfactants for use in the compositions of the present invention include the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12}$ alcohol with 5 moles of ethylene oxide; the condensation product of $C_{12-13}$ alcohol with 6.5 moles of ethylene oxide, and the same condensation product which is stripped so as to remove substantially all lower ethoxylate and nonethoxylated fractions; the condensation product of $C_{12-13}$ alcohol with 3 moles of ethylene oxide, and the same condensation product which is stripped so as to remove substantially all lower ethoxylate and nonethoxylated fractions; the condensation product of $C_{12-13}$ alcohol with 9 moles of ethylene oxide; the condensation product of $C_{14-15}$ alcohol with 2.25 moles of ethylene oxide; the condensation product of $C_{14-15}$ alcohol with 4 moles of ethylene oxide; the condensation product of $C_{14-15}$ alcohol with 7 moles of ethylene oxide; and the condensation product of $C_{14-15}$ alcohol with 9 moles of ethylene oxide.

The compositions of the present invention may contain mixtures of the preferred alcohol ethoxylate nonionic surfactants together with other types of nonionic surfactants. Preferred nonionic surfactant mixtures contain at least one of the preferred alcohol ethoxylate nonionics, and have a ratio of the preferred alcohol ethoxylate surfactant (or surfactants) to the other nonionic surfactant (or surfactants) of from about 1:1 to about 5:1. Specific examples of surfactant mixtures useful in the present invention include a mixture of the condensation product of $C_{14-15}$ alcohol with 3 moles of ethylene oxide (Neodol 45-3) and the condensation product of $C_{14-15}$ alcohol with 9 moles of ethylene oxide (Neodol 45-9), in a ratio of lower ethoxylate nonionic to higher ethoxylate nonionic of from about 1:1 to about 3:1; a mixture of the condensation product of $C_{10}$ alcohol with 3 moles of ethylene oxide together with the condensation product of a secondary $C_{15}$ alcohol with 9 moles of ethylene oxide (Tergitol 15-S-9), in a ratio of lower ethoxylate nonionic to higher ethoxylate nonionic of from about 1:1 to about 4:1; a mixture of Neodol 45-3 and Tergitol 15-S-9, in a ratio of lower ethoxylate nonionic to higher ethoxylate nonionic of from about 1:1 to about 3:1; and a mixture of Neodol 45-3 with the condensation product of myristyl alcohol with 10 moles of ethylene oxide, in a ratio of lower ethoxylate to higher ethoxylate of from about 1:1 to about 3:1.

Preferred nonionic surfactant mixtures may also contain alkyl glyceryl ether compounds together with the preferred alcohol ethoxylate surfactants. Particularly preferred are glyceryl ethers having the formula $$R-O(CH_2CH_2O)_nCH_2\underset{\underset{OH}{|}}{C}HCH_2OH$$

wherein R is an alkyl or alkenyl group of from about 8 to about 18, preferably about 8 to 12, carbon atoms or an alkaryl group having from about 5 to 14 carbons in the alkyl chain, and n is from 0 to about 6, together with the preferred alcohol ethoxylates, described above, in a ratio of alcohol ethoxylate to glyceryl ether of from about 1:1 to about 4:1, particularly about 7:3. Glyceryl ethers of the type useful in the present invention are disclosed in U.S. patent application Ser. No. 644,214, Jones, filed Dec. 24, 1975, now abandoned; and U.S. Pat. No. 4,098,713, Jones, issued July 4, 1978; both of which are incorporated herein by reference.

Cationic Component

The compositions of the present invention contain a cationic surfactant, or a mixture of such surfactants, which undergo degradation, through hydrolysis, when they are placed in an alkaline, aqueous environment. Such surfactants contain one or more linkages which are subject to attack by hydroxide ions in solution. Examples of such linkages include $$-\overset{O}{\overset{\|}{C}}-,\ -\overset{O}{\overset{\|}{C}}-O-,\ -O-\overset{O}{\overset{\|}{C}}-,\ -O-,\ -O-\overset{O}{\overset{\|}{C}}-O-,$$
$$-\overset{O}{\overset{\|}{C}}-\overset{H}{\overset{|}{N}}-,\ -\overset{H}{\overset{|}{N}}-\overset{O}{\overset{\|}{C}}-,\ -O-\overset{O}{\overset{\|}{C}}-\overset{H}{\overset{|}{N}}-,\ \text{and}\ -\overset{H}{\overset{|}{N}}-\overset{O}{\overset{\|}{C}}-O-.$$

Preferred surfactants are those containing ester, reverse ester, amide, or reverse amide linkages.

Preferred compositions include the cationic surfactants which are described in U.S. patent application Ser. Nos. 919,343 and 919,344, Letton, both filed June 26, 1978, the disclosures of both applications being incorporated herein by reference. These surfactants exhibit excellent biodegradability characteristics, as long as they do not contain highly-branched substituents. One type of surfactant useful in the present invention has the formula $$R^2-(Z^1)_a-(R^3)_n-Z^2-(CH_2)_m-\overset{\overset{R^1}{|}}{\underset{\underset{R^1}{|}}{N}}{}^+-R^1X^-$$

wherein $R^1$ is $C_1$ to $C_4$ alkyl or hydroxyalkyl; $R^2$ is $C_5$ to $C_{30}$ straight or branched chain alkyl or alkenyl, alkyl phenyl, or $$X^-R^1-\overset{\overset{R^1}{|}}{\underset{\underset{R^1}{|}}{N}}{}^+-(CH_2)_s-;$$

wherein s is from 0 to 5; $R^3$ is $C_1$ to $C_{20}$ alkyl or alkenyl; a is 0 or 1, n is 0 or 1, and a is 1 only when n is 1; m is from 1 to 5; $Z^1$ and $Z^2$ are each selected from the group consisting of $$-\overset{O}{\overset{\|}{C}}-O-,\ -O-\overset{O}{\overset{\|}{C}}-,\ -O-,\ -O-\overset{O}{\overset{\|}{C}}-O-,\ -\overset{O}{\overset{\|}{C}}-\overset{H}{\overset{|}{N}}-,$$
$$-\overset{H}{\overset{|}{N}}-\overset{O}{\overset{\|}{C}}-,\ -O-\overset{O}{\overset{\|}{C}}-\overset{H}{\overset{|}{N}},\ -\overset{H}{\overset{|}{N}}-\overset{O}{\overset{\|}{C}}-O-,$$

and wherein at least one of said groups is an ester, reverse ester, amide or reverse amide; and X is an anion which makes the compound at least water-dispersible, preferably selected from the group consisting of halide, methyl sulfate, sulfate, and nitrate, preferably methyl sulfate, chloride, bromide or iodide.

Particularly preferred cationic surfactants of this type are the choline ester derivatives having the following formula:

$$R^2-\overset{O}{\overset{\|}{C}}-O-CH_2CH_2-\overset{\overset{CH_3}{|}}{\underset{\underset{CH_3}{|}}{N}}{}^+-CH_3X^-,$$

as well as those wherein the ester linkage in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{15}$ alkyl), myristoyl choline ester quaternary ammonium halides ($R^2=C_{13}$ alkyl), lauroyl choline ester ammonium halides ($R^2=C_{11}$ alkyl), and tallowyl choline ester quaternary ammonium halides ($R^2=C_{15}$-$C_{17}$ alkyl).

Additional preferred cationic components of the choline ester variety are given by the structural formulas below, wherein p may be from 0 to 20.

$$R^2-O-\overset{O}{\overset{\|}{C}}-(CH_2)_p\overset{O}{\overset{\|}{C}}-O-CH_2CH_2-\overset{\overset{CH_3}{|}}{\underset{\underset{CH_3}{|}}{N}}{}^+-CH_3X^-$$

$$X^-CH_3-\overset{\overset{CH_3}{|}}{\underset{\underset{CH_3}{|}}{N}}{}^+-CH_2-CH_2-O-\overset{O}{\overset{\|}{C}}-(CH_2)_p-\overset{O}{\overset{\|}{C}}-O-CH_2-CH_2-\overset{\overset{CH_3}{|}}{\underset{\underset{CH_3}{|}}{N}}{}^+-CH_3X^-$$

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize trimethylamine, forming the desired cationic component.

Another type of cationic surfactant, useful in the compositions of the present invention, has the formula $$R^3-O[(\overset{R^2}{\overset{|}{C}H})_nO]_y-(Z^1)_a-(R^4)_t-Z^2-(CH_2)_m-\underset{R^1}{\overset{R^1}{\overset{|}{\underset{|}{N^+}}}}-R^1X^-$$

In the above formula, each $R^1$ is a $C_1$ to $C_4$ alkyl or hydroxyalkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenylene, alkyl phenyl, or alkyl benzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1, t may be 0 or 1, and a can be 1 only when t is 1; and m is from 1 to 5, preferably 2. $Z^2$ is selected from the group consisting of:

$$-\overset{O}{\overset{\|}{C}}-O-,\ -\overset{O}{\overset{\|}{C}}-,\ -O-,\ -O-\overset{O}{\overset{\|}{C}}-O-,\ -\overset{O}{\overset{\|}{C}}-\overset{H}{\overset{|}{N}}-,$$

$$-\overset{H}{\overset{|}{N}}-\overset{O}{\overset{\|}{C}}-,\ -O-\overset{O}{\overset{\|}{C}}-\overset{H}{\overset{|}{N}}-,\ -\overset{H}{\overset{|}{N}}-\overset{O}{\overset{\|}{C}}-O-,$$

$Z^1$ is selected from the group consisting of $$-\overset{O}{\overset{\|}{C}}-O-,\ -\overset{O}{\overset{\|}{C}}-,\ -\overset{O}{\overset{\|}{C}}-\overset{H}{\overset{|}{N}}-,\ -\overset{H}{\overset{|}{N}}-\overset{O}{\overset{\|}{C}}-,\ -\overset{H}{\overset{|}{N}}-\overset{O}{\overset{\|}{C}}-O-,$$

and wherein at least one of said $Z^1$ and $Z^2$ groups is selected from the group consisting of ester, reverse ester, amide and reverse amide. X is an anion which will make the compound at least water-dispersible, and is selected from the group consisting of halides, methyl sulfate, sulfate, and nitrate, particularly methyl sulfate, chloride, bromide and iodide. Mixtures of the above structures can also be used.

Preferred embodiments of this type of cationic component are the choline ester derivatives ($R^1$ is a methyl group and $Z^2$ is an ester or reverse ester group), particular formulas of which are given below, in which t is 0 or 1, y is from 1 to 20 and $R^3$ and X are defined above.

$$R^3-O(CH_2CH_2O)_y-(CH_2)_t-\overset{O}{\overset{\|}{C}}-O-CH_2-CH_2-\underset{CH_3}{\overset{CH_3}{\overset{|}{\underset{|}{N^+}}}}-CH_3X^-$$

$$R^3-O(CH_2CH_2O)_y-\overset{O}{\overset{\|}{C}}-CH_2-\underset{CH_3}{\overset{CH_3}{\overset{|}{\underset{|}{N^+}}}}-CH_3X^-$$

$$R^3-O(\overset{CH_3}{\overset{|}{C}}HCH_2O)_y-\overset{O}{\overset{\|}{C}}-CH_2-\underset{CH_3}{\overset{CH_3}{\overset{|}{\underset{|}{N^+}}}}-CH_3X^-$$

$$R^3-O(\overset{CH_3}{\overset{|}{C}}HCH_2O)_y-(CH_2)_t-\overset{O}{\overset{\|}{C}}-O-CH_2-CH_2-\underset{CH_3}{\overset{CH_3}{\overset{|}{\underset{|}{N^+}}}}-CH_3X^-$$

$$R^3-O(CH_2CH_2O)_y-\overset{O}{\overset{\|}{C}}-(CH_2)_t-\overset{O}{\overset{\|}{C}}-O-CH_2CH_2-\underset{CH_3}{\overset{CH_3}{\overset{|}{\underset{|}{N^+}}}}-CH_3X^-$$

$$R^3-O(CH_2CH_2O)_y-\overset{O}{\overset{\|}{C}}-\overset{H}{\overset{|}{C}}=\overset{H}{\overset{|}{C}}-\overset{O}{\overset{\|}{C}}-O-CH_2CH_2-\underset{CH_3}{\overset{CH_3}{\overset{|}{\underset{|}{N^+}}}}-CH_3X^-$$

$$R^3-O(CH_2CH_2CH_2CH_2O)_y-\overset{O}{\overset{\|}{C}}-CH_2-\underset{CH_3}{\overset{CH_3}{\overset{|}{\underset{|}{N^+}}}}-CH_3X^-$$

$$R^3-O(CH_2CH_2CH_2CH_2O)_y-(CH_2)_t-\overset{O}{\overset{\|}{C}}-O-CH_2CH_2-\underset{CH_3}{\overset{CH_3}{\overset{|}{\underset{|}{N^+}}}}-CH_3X^-$$

Mixtures of any of the above cationic surfactants may also be used in the compositions of the present invention.

The preferred choline derivatives, described above, may be prepared by the reaction of a long chain alkyl polyalkoxy (preferably polyethoxy) carboxylate, having an alkyl chain of desired length, with oxalyl chloride, to form the corresponding acid chloride. The acid chloride is then reacted with dimethylaminoethanol to form the appropriate amine ester, which is then quaternized with a methyl halide to form the desired choline ester compound. Another way of preparing these compounds is by the direct esterification of the appropriate long chain ethoxylated carboxylic acid together with 2-haloethanol or dimethyl aminoethanol, in the presence of heat and an acid catalyst. The reaction product formed is then quaternized with methylhalide or used to quaternize trimethylamine to form the desired choline ester compound.

Alkaline Component

The compositions of the present invention also contain from about 1% to about 25%, preferably from about 5% to about 20%, and most preferably from about 8% to about 16%, of an inorganic alkalinity-producing component, preferably as the compositions' sole alkalinity-producing component. These components must be chosen such that they are relatively insoluble in the cationic or nonionic/cationic surfactant component included in the composition. Thus, alkalinity sources such as monoethanolamine and triethanolamine, which are often used as alkalinity sources in detergent compositions, are not useful in the compositions of the present invention, since they tend to be too soluble in cationic/-nonionic surfactant mixtures. The particular alkaline component used must also be selected and included in an amount such that the detergent composition forms a solution having a pH of from about 8 to about 10, preferably from about 8.5 to about 9.5, within about 3 minutes, preferably within about 2 minutes, most preferably within about 1 minute, after it is placed in 100° F. water at a concentration of about 0.15% by weight. Thus, anhydrous borax is not useful in the compositions of the present invention since it dissolves too slowly to give the desired pH within the required time period.

Preferred alkaline components for use in the compositions of the present invention include sodium tetraborate decahydrate ($Na_2B_4O_7.10H_2O$; borax decahydrate), sodium tetraborate pentahydrate ($Na_2B_4O_7.5H_2O$; borax pentahydrate), sodium carbonate, and mixtures of these components. Particularly preferred alkalinity-producing components are borax pentahydrate and borax decahydrate and mixtures thereof.

Preferred embodiments of the present invention additionally contain from about 2 to about 25%, preferably from about 2 to about 16%, and most preferably from about 3 to about 10%, of a fatty amide surfactant. The ratio of the total cationic and nonionic surfactant components contained in the composition to the amide component is from about 5:1 to about 50:1, preferably from about 8:1 to about 25:1. These preferred embodiments yield excellent particulate soil removal performance, as well as improved soil anti-redeposition characteristics, and the development is described in U.S. patent application Ser. No. 919,340, Cambre, filed June 26, 1978, incorporated herein by reference.

The compositions of the present invention may also contain additional ingredients generally found in laundry detergent compositions, at their conventional art-established levels, as long as these ingredients are compatible with the nonionic and cationic components. For example, the compositions may contain up to about 15%, preferably up to about 5%, and most preferably from about 0.1% to about 2% of a suds suppressor component. Typical suds suppressors include long chain fatty acids, such as those described in U.S. Pat. No. 2,954,347, issued Sept. 27, 1960, St. John, and combinations of certain nonionics therewith as disclosed in U.S. Pat. No. 2,954,348, issued Sept. 27, 1960, Schwoeppe, both disclosures being incorporated herein by reference. Other suds suppressor components useful in the compositions of the present invention include, but are not limited to, those described below.

Preferred suds suppressing additives are described in U.S. Pat. No. 3,933,672, issued Jan. 20, 1976, Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as a siloxane having the formula:

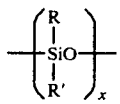

wherein x is from about 20 to about 2,000, and R and R' are each alkyl or aryl groups, especially methyl, ethyl, propyl, butyl and phenyl. The polydimethylsiloxanes (R and R' are methyl) having a molecular weight within the range of from about 200 to about 200,000, and higher, are all useful as suds controlling agents. Additional suitable silicone materials wherein the side chain groups R and R' are alkyl, aryl, or mixed alkyl and aryl hydrocarbyl groups exhibit useful suds controlling properties. Examples of such ingredients include diethyl-, dipropyl-, dibutyl-, methyl- ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/gm$. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. patent application Ser. No. 841,078, Gault et al, filed Oct. 11, 1977, which is a continuation-in-part of U.S. patent application Ser. No. 622,303, Gault et al, filed Oct. 14, 1975, now abandoned, both of which are incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole percent of dialkyl phosphate and up to about 5 mole percent of trialkyl phosphate.

Other adjunct components which may be included in the compositions of the present invention, in their conventional art-established levels for use (i.e., from 0 to about 40%), include anionic, zwitterionic and ampholytic cosurfactants, detergency builders, bleaching agents, bleach activators, soil-suspending agents, corrosion inhibitors, dyes, fillers, optical brighteners, germicides, pH adjusting agents, enzymes, enzyme-stabilizing agents, perfumes, fabric softening components, static control agents, and the like. However, because of the numerous and diverse performance advantages of the preferred compositions of the present invention, certain types of adjunct components, such as detergency builders, static control agents, fabric softening agents and germicides, will not usually be necessary.

Examples of cosurfactants and detergency builders, which may be used in the compositions of the present invention, are found in U.S. Pat. No. 3,717,630, Booth, issued Feb. 20, 1973, and U.S. patent application Ser. No. 811,220, Murphy, filed June 29, 1977, now abandoned, both of which are incorporated herein by reference.

The compositions of the present invention may be manufactured and used in a variety of forms, such as solids, powders, granules, pastes, or liquids. The compositions are particularly well suited for incorporation into substrate articles for use in the home laundering process. Examples of such articles are described in U.S. patent application Ser. No. 781,378, Flesher et al, filed Mar. 25, 1977; U.S. Pat. No. 4,095,946, Jones et al, issued June 20, 1978; U.S. Pat. No. 4,118,525, Jones issued Oct. 3, 1978; and U.S. Pat. No. 4,113,630, Hagner et al, issued Sept. 12, 1978, all of the disclosures of which are incorporated herein by reference. These articles consist of a water-insoluble substrate which releasably incorporates an effective amount, preferably from about 3 to 120 grams, particularly from about 20 to 80 grams, of the detergent compositions of the present invention. When the compositions of the present invention are used in substrate articles it may be advantageous to include the solubilization aids, described in copending U.S. patent application Ser. No. 864,050, Cambre, incorporated herein by reference, and the anti-bleeding components, described in copending U.S. patent application Ser. No. 864,136, Rodriguez, also incorporated herein by reference.

The compositions of the present invention are used in the laundering process by forming an aqueous solution containing from about 0.01 (100 parts per million) to 0.3% (3,000 parts per million), preferably from about 0.02 to 0.2%, and most preferably from about 0.03 to about 0.15%, of the compositions of the present invention, and agitating the soiled fabrics in that solution. The fabrics are then rinsed and dried. When used in this manner, the preferred compositions of the present invention yield exceptionally good particulate soil, oily body soil and greasy/oily soil removal performance, as well as fabric softening, static control, and dye transfer inhibition benefits to the fabrics laundered therewith. Further, the compositions are stable upon storage, and exhibit a minimum of hydrolysis of the cationic component when placed in laundry solution.

All percentages, parts, and ratios used herein are by weight unless otherwise specified.

The following nonlimiting examples illustrate the compositions and method of the present invention.

EXAMPLE I

The storage and wash solution stability of detergent compositions containing various types of alkalinity-producing components were tested in the following manner.

The detergent compositions tested contained the cationic surfactant having the formula:

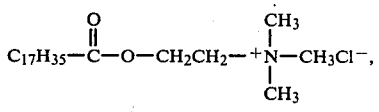

present in an amount yielding a concentration of 143 ppm in the test wash solution, together with the condensation product of coconut alcohol with 5 moles of ethylene oxide, present in an amount yielding a concentration of 357 ppm in the test wash solution. The compositions additionally contained the alkalinity-producing components, given in the table below, in the amounts specified. Each composition was added to a four liter beaker, containing about three liters of water at 100° F. (7 grains per gallon of mixed calcium and magnesium hardness). The solutions were stirred for about ten minutes and samples were taken at the end of that time. For each solution, the pH and the percent loss of the cationic component was determined. The percent loss of the cationic component in the wash solution was determined by mixed indicator titration.

In the mixed indicator titration, a wash solution sample, containing the cationic surfactant (some of which had been hydrolyzed), was combined with a mixed indicator of cationic- and anionic-complexing dyes, in a water-chloroform system. A known amount of 0.00400 N $C_{11.8}$ linear alkylbenzene sulfonate was added to provide an excess of anionic surfactant. A complex of anionic surfactant, hydrolysis fragment, and cationic dye was formed; this complex was soluble in the chloroform layer, giving it a red-pink color. The solution was then titrated with an approximately 0.00400 N solution of Hyamine 1622 (di-isobutyl phenoxy ethoxy ethyl dimethylbenzyl ammonium chloride, available from Rohm and Haas), destroying the dye/surfactant complex and the pink color. A color change to grey in the chloroform layer indicated the end point, and the amount of the hydrolysis fragment present was calculated, based on the amount of Hyamine used in the titration.

The percent loss of the cationic component during storage was determined by taking a sample (approximately 6 grams) of each detergent composition, placing the sample in a closed Petri dish, and storing the dishes, for a four week period, under conditions of 80° F./60% relative humidity; 80° F./80% relative humidity; and 120° F./60% relative humidity. The percent loss of the cationic component was determined at various stages during storage by the mixed indicator titration technique, described above. The data obtained are summarized in the table below:

| | ppm | pH (after 1 minute in solution) | % loss (after 10 minutes in solution) | % loss-storage (4 weeks) |
|---|---|---|---|---|
| Monoethanolamine | 30.5 | 9.45 | 16 | 75–100 (in 48 hours) |
| | 45 | 9.65 | 24.3 | — |
| | 66.7 | 9.8 | 27 | — |
| Triethanolamine | 100 | — | — | 30 (12 days) |
| Sodium sesquicarbonate | 90 | 9.6 | 22.8 | — |
| Borax . 5 $H_2O$ | 72 | ~9.2–9.4 | — | <15 |
| Borax . 10 $H_2O$ | 45 | 9.3 | 9 | <15 |
| | 90 | 9.5 | 8 | <15 |
| Sodium carbonate | 5.6 | 9.0 | 6.6 | <15 |
| | 16.7 | 9.4 | 13.5 | <15 |
| | 30.5 | 9.62 | 17.5 | — |
| | 45 | 9.74 | 27 | — |

The above data demonstrate that acceptable wash and storage stability of the cationic component is obtained when the alkalinity-producing components defined herein are included in the detergent compositions in the required amounts.

Similar results are obtained where the nonionic component used above is replaced by the condensation product of $C_{10}$ alcohol with three moles of ethylene oxide, the condensation product of coconut alcohol with six moles of ethylene oxide, the condensation product of coconut alcohol with 7 moles of ethylene oxide, the condensation product of $C_{12-13}$ alcohol with 6.5 moles of ethylene oxide, the condensation product of $C_{14-15}$ alcohol with 7 moles of ethylene oxide, or the condensation product of $C_{12-13}$ alcohol with three moles of ethylene oxide stripped so as to remove the lower ethoxylate and unethoxylated fractions.

Excellent stability results are also obtained where the detergent composition includes nonionic to cationic surfactant weight ratios of about 100:1, 50:1, 35:1, 25:1, 15:1, 10:1, 7:1, 5:1, 4:1, 10:3, 20:7, 20:9, 2:1, or 5:3.

Excellent results are also obtained where the nonionic component, used above, is replaced by a mixture of the condensation product of $C_{14-15}$ alcohol with three moles of ethylene oxide together with the condensation product of $C_{14-15}$ alcohol with 7 moles of ethylene oxide, in a ratio of lower ethoxylate nonionic to higher ethoxylate nonionic of about 2:1, a mixture of the condensation product of $C_{14-15}$ alcohol with 3 moles of ethylene oxide together with the condensation product of myristyl alcohol with 10 moles of of ethylene oxide, in a ratio of lower ethoxylate nonionic to higher ethoxylate nonionic of about 1:1, or a mixture of the condensation product of coconut alcohol with 5 moles of ethylene oxide together with an alkyl glyceryl ether having the formula $$C_{12}H_{25}-OCH_2-\underset{\underset{OH}{|}}{CH}-CH_2OH$$

in a ratio of alcohol ethoxylate to glyceryl ether of about 7:3.

Substantially similar stability results are also obtained where the cationic component is replaced by those having the formulae given below, or mixtures of those sufactants:

$$C_{16}H_{33}-\overset{\overset{O}{\|}}{C}-O-CH_2CH_2-\overset{\overset{CH_3}{|}}{\underset{\underset{CH_3}{|}}{N^+}}-CH_3Br^-$$

$$C_{12}H_{25}-O-\overset{\overset{O}{\|}}{C}-CH_2CH_2-\overset{\overset{O}{\|}}{C}-O-CH_2CH_2-\overset{\overset{CH_3}{|}}{\underset{\underset{CH_3}{|}}{N^+}}-CH_3Cl^-$$

$$Br^-CH_3-\overset{\overset{CH_3}{|}}{\underset{\underset{CH_3}{|}}{N^+}}-CH_2CH_2-O-\overset{\overset{O}{\|}}{C}-(CH_2)_{12}-\overset{\overset{O}{\|}}{C}-O-CH_2CH_2-\overset{\overset{CH_3}{|}}{\underset{\underset{CH_3}{|}}{N^+}}-CH_3Br^-$$

$$C_{10}H_{21}-O-(CH_2CH_2O)_{10}-\overset{\overset{O}{\|}}{C}-CH_2-\overset{\overset{CH_3}{|}}{\underset{\underset{CH_3}{|}}{N^+}}-CH_3Cl^-$$

$$C_{13}H_{27}-O-(\overset{\overset{CH_3}{|}}{C}HCH_2O)_{11}-\overset{\overset{O}{\|}}{C}-CH_2-\overset{\overset{CH_3}{|}}{\underset{\underset{CH_3}{|}}{N^+}}-CH_3Br^-$$

EXAMPLE II

A heavy-duty liquid laundry detergent composition, having the formula given below, is produced by mixing together the following components in the stated proportions.

| Component | Weight % |
|---|---|
| $C_{17}H_{35}-\overset{O}{\overset{\|\|}{C}}-O-CH_2CH_2-\overset{CH_3}{\underset{CH_3}{\overset{\|}{\underset{\|}{{}^{+}N}}}}-CH_3\ Cl^-$ | 26.1 |
| Condensation product of coconut alcohol with 5 moles of ethylene oxide | 51.5 |
| Borax . 10 $H_2O$ | 11.5 |
| Ethanol | 9.0 |
| Minors (suds suppressor, perfume, brighteners, etc.) | balance to 100 |

This composition provides excellent removal of both clay and greasy/oily soils, as well as storage and wash solution stability of the cationic component.

EXAMPLE III

A paste-form laundry detergent composition, having the formula given below, is prepared by mixing together the following components in the stated proportions.

| Component | Weight % |
|---|---|
| $C_{17}H_{35}-\overset{O}{\overset{\|\|}{C}}-O-CH_2CH_2-\overset{CH_3}{\underset{CH_3}{\overset{\|}{\underset{\|}{{}^{+}N}}}}-CH_3\ Cl^-$ | 26.0 |
| Condensation product of coconut alcohol with 5 moles of ethylene oxide | 51.5 |
| $C_{12-16}$ fatty acid ammonia amide | 7.0 |
| Borax . 5 $H_2O$ | 13.0 |
| Minors (suds suppressor, perfume, brightener, etc.) | balance to 100 |

This composition, when used as a paste or in a substrate article, as described hereinafter, provides excellent removal of both clay and greasy/oily soils, as well as storage and wash solution stability of the cationic component.

EXAMPLE IV

A substrate article, for use in the automatic machine laundering of fabrics, is made by coating one side of an 8"×11" sheet of a Scott 8050 Industrial Towel, having an air permeability of about 130 cu. ft./min./sq. ft., a basis weight of about 77.5 grams per square yard, and a thickness of 44 mils, with about 50 grams of the detergent composition having the formulation given below. The composition is made by intimately mixing the nonionic and cationic surfactants together, at a temperature of about 80° C., to form a thick paste, and then mixing in the remaining components.

| Component | Weight % |
|---|---|
| $C_{17}H_{35}-\overset{O}{\overset{\|\|}{C}}-O-CH_2CH_2-\overset{CH_3}{\underset{CH_3}{\overset{\|}{\underset{\|}{{}^{+}N}}}}-CH_3\ Cl^-$ | 21.4 |
| Condensation product of coconut alcohol with 5 moles of ethylene oxide | 42.2 |
| $C_{12-16}$ fatty acid ammonia amide | 5.9 |
| Borax . 5 $H_2O$ | 10.8 |
| Choline chloride | 10.6 |
| Zeosyl 200 (a silica material having an average particle size of about 2 microns, commercially available from J. M. Huber Corp.) | 9.1 |

An identical sheet of the paper towel is placed over the coated side of the original sheet, and the edges of the two sheets are sewn together so as to enclose the composition. This article provides a convenient method for introducing the compositions of the present invention into the laundering solution, as well as providing excellent cleaning performance, and wash solution and storage stability of the cationic component.

A substrate article may also be made by coating one side of an 11"×11" sheet of melt-blown polypropylene, having a thickness of about 29 mils, a basis weight of about 58.5 grams per square yard, and an air permeability of about 66 cubic ft./min./sq. ft., with about 60 grams of the detergent composition described above, placing an identical substrate sheet over the coated sheet, and heat sealing together the edges of the two substrates, enclosing the detergent composition within the article.

EXAMPLE V

A heavy-duty liquid laundry detergent composition, having the formula given below, is prepared by mixing together the following components in the stated proportions.

| Component | Wt. % |
|---|---|
| $C_{12}H_{25}-(C_2H_4O)_7-CH_2-\overset{O}{\overset{\|\|}{C}}-O-C_2H_4-\overset{CH_3}{\underset{CH_3}{\overset{\|}{\underset{\|}{{}^{+}N}}}}-CH_3\ Cl^-$ | 20.3 |
| Condensation product of $C_{14-15}$ alcohol with 7 moles of ethylene oxide | 47.7 |
| Borax . 5 $H_2O$ | 12.0 |
| Lauramide | 7.0 |
| Ethanol | 10.0 |
| Minors (suds suppressor, perfume, brightener, etc.) | balance to 100 |

This product, when used in an automatic laundering operation, at a concentration of about 0.5%, provides excellent removal of both particulate and greasy/oily soils, while exhibiting stability of the cationic component in the wash solution and during storage.

EXAMPLE VI

A substrate article, for use in the automatic laundering operation, having the composition given below, is made using the procedure outlined in Example IV, above, with Scott 8050 Industrial Towels as the substrate material.

| Component | Weight % |
|---|---|
| $C_{17}H_{35}-\overset{O}{\overset{\|\|}{C}}-O-CH_2CH_2-\overset{CH_3}{\underset{CH_3}{\overset{\|}{\underset{\|}{{}^{+}N}}}}-CH_3\ Cl^-$ | 24.6 |
| Condensation product of coconut alcohol with 5 moles of ethylene oxide | 61.6 |

-continued

| Component | Weight % |
|---|---|
| $C_{12-16}$ fatty acid ammonia amide | 7.8 |
| Borax . 10 $H_2O$ | 4.2 |
| Minors (suds suppressor, perfume, brightener, etc.) | balance to 100 |

This article provides a convenient method for introducing the compositions of the present invention into the laundering solution, and, in addition, exhibits excellent storage and wash solution stability for the cationic component.

What is claimed is:

1. A laundry detergent composition which comprises:

(a) from about 2% to about 95% of a surfactant mixture consisting essentially of:

(1) a nonionic surfactant having an HLB of from about 5 to about 17; and (2) a cationic surfactant selected from the group consisting of:

$$R^2-(Z^1)_a-(R^3)_n-Z^2-(CH_2)_m-\overset{\overset{R^1}{|}}{\underset{\underset{R^1}{|}}{N}}{}^{+}-R^1\,X^- \qquad \text{(i)}$$

wherein each $R^1$ is $C_1$ to $C_4$ alkyl or hydroxyalkyl; $R^2$ is $C_5$ to $C_{30}$ straight or branched chain alkyl, alkenyl, alkylbenzyl, or alkyl phenyl group or $$X^-\,R^1-\overset{\overset{R^1}{|}}{\underset{\underset{R^1}{|}}{{}^{+}N}}-(CH_2)_s-,$$

wherein s is from 0 to 5; $R^3$ is $C_1$ to $C_{20}$ alkylene or alkenylene; a is 0 or 1, n is 0 or 1, and a is 1 only when n is 1; m is from 1 to 5; $Z^1$ and $Z^2$ are each selected from the group consisting of:

$$-\overset{O}{\overset{\|}{C}}-O-,\ -O-\overset{O}{\overset{\|}{C}}-,\ -O-,\ -O-\overset{O}{\overset{\|}{C}}-O-,\ -\overset{O}{\overset{\|}{C}}-\overset{H}{\overset{|}{N}}-,$$
$$-\overset{H}{\overset{|}{N}}-\overset{O}{\overset{\|}{C}}-,\ -O-\overset{O}{\overset{\|}{C}}-\overset{H}{\overset{|}{N}},\ -\overset{H}{\overset{|}{N}}-\overset{O}{\overset{\|}{C}}-O-,$$

and wherein at least one of said groups is selected from the group consisting of ester, reverse ester, amide and reverse amide and X is an anion which makes the surfactant at least water-dispersible;

$$R^3-O[(CH)_nO]_y-(Z^1)_a-(R^4)_t-Z^2-(CH_2)_m-\overset{\overset{R^1}{|}}{\underset{\underset{R^1}{|}}{N}}{}^{+}-R^1\,X^- \qquad \text{(ii)}$$

wherein each $R^1$ is $C_1$ to $C_4$ alkyl or hydroxyalkyl; each $R^2$ is either hydrogen or $C_1$ to $C_3$ alkyl; $R^3$ is $C_4$ to $C_{30}$ straight or branched chain alkyl, alkenyl or alkylbenzyl, $R^4$ is $C_1$ to $C_{10}$ alkylene or alkenylene; n is from 2 to 4; y is from 1 to 20; a is 0 or 1, t is 0 or 1, and a can be 1 only when t is 1; m is from 1 to 5; $Z^2$ is selected from the group consisting of $$-\overset{O}{\overset{\|}{C}}-O-,\ -\overset{O}{\overset{\|}{C}}-,\ -O-,\ -\overset{O}{\overset{\|}{C}}-\overset{H}{\overset{|}{N}}-,$$
$$-\overset{H}{\overset{|}{N}}-\overset{O}{\overset{\|}{C}}-,\ -O-\overset{O}{\overset{\|}{C}}-\overset{H}{\overset{|}{N}}-,\ -\overset{H}{\overset{|}{N}}-\overset{O}{\overset{\|}{C}}-O-;$$

$Z^1$ is selected from the group consisting of $$-\overset{O}{\overset{\|}{C}}-\text{and}\ -\overset{O}{\overset{\|}{C}}-\overset{H}{\overset{|}{N}}-,$$

said selections being made so that $$R^3-O[(\overset{\overset{R^2}{|}}{C}H)_nO]_y-(Z^1)_a-(R^4)_t-Z^2-(CH_2)_m-$$

is an alkyl or alkenyl group which can be interrupted by only structures selected from the group consisting of:

$$-\overset{O}{\overset{\|}{C}}-O-,\ -O-\overset{O}{\overset{\|}{C}}-,\ -\overset{O}{\overset{\|}{C}}-\overset{H}{\overset{|}{N}}-,\ -\overset{H}{\overset{|}{N}}-\overset{O}{\overset{\|}{C}}-,\ -O-,$$
$$-O-\overset{O}{\overset{\|}{C}}-O-,\ -O-\overset{O}{\overset{\|}{C}}-\overset{H}{\overset{|}{N}}-,\ \text{and}\ -\overset{H}{\overset{|}{N}}-\overset{O}{\overset{\|}{C}}-O-$$

and wherein at least one of said $Z^1$ and $Z^2$ groups is selected from the group consisting of ester, reverse ester, amide, and reverse amide; and X is an anion which makes the surfactant at least water-dispersible; and (iii) mixtures thereof;

wherein the ratio of said nonionic surfactant to said cationic surfactant is in the range of from about 1:1 to about 100:1; and (b) from about 1% to about 25% of an inorganic alkaline component selected from the group consisting of borax decahydrate, borax pentahydrate, sodium carbonate, and mixtures thereof, and which is present in an amount such that the detergent composition forms a solution having a pH of from about 8 to about 10 within about 3 minutes after it is placed in 100° F. water at a concentration of about 0.15%.

2. The composition according to claim 1 wherein the nonionic surfactant is biodegradable and has the formula $R(OC_2H_4)_nOH$ wherein R is a primary or secondary alkyl chain of from about 8 to about 22 carbon atoms and n is an average of from about 2 to about 12.

3. The composition according to claim 2 which contains from about 5% to about 20% of said inorganic alkaline component.

4. The composition according to claim 3 wherein said alkaline component is contained in an amount such that the composition forms a solution having a pH of from about 8.5 to about 9.5, within about 2 minutes, when placed in 100° F. water at a concentration of about 0.15%.

5. The composition according to claim 4 which contains from about 8% to about 16% of said alkaline component.

6. The composition according to claim 2 which contains from about 10% to about 90% of said cationic/nonionic surfactant mixture.

7. The composition according to claim 6 which contains from about 15% to about 85% of a said cationic/-nonionic surfactant mixture.

8. The composition according to claim 7 wherein the ratio of nonionic surfactant to cationic surfactant is from about 5:3 to about 50:1.

9. The composition according to claim 8 wherein, in the nonionic surfactant, R is a $C_{10}$-$C_{20}$ alkyl group.

10. The composition according to claim 9 wherein, in the nonionic surfactant, n is from 2 to 9.

11. The composition according to claim 10 wherein the ratio of nonionic surfactant to cationic surfactant is from about 5:3 to about 20:1.

12. The composition according to claim 11 wherein the cationic surfactant has the formula $$R^2-(Z^1)_a-(R^3)_n-Z^2-(CH_2)_m-\overset{\overset{R^1}{|}}{\underset{\underset{R^1}{|}}{N}}{}^+-R^1X^-$$

wherein $Z^2$ is selected from the group consisting of ester, reverse ester, amide, and reverse amide.

13. The composition according to claim 12 wherein $Z^2$ is $$-\overset{\overset{O}{\|}}{C}-O-.$$

14. The composition according to claim 13 wherein n is 0 and a is 0.

15. The composition according to claim 14 wherein $R^2$ is a $C_8$-$C_{20}$ alkyl group.

16. The composition according to claim 15 wherein m is 2.

17. The composition according to claim 11 wherein the cationic surfactant has the formula $$R^3-O[\overset{\overset{R^2}{|}}{(CH)}_nO]_y-(Z^1)_a-(R^4)_t-Z^2-(CH_2)_m-\overset{\overset{R^1}{|}}{\underset{\underset{R^1}{|}}{N}}{}^+-R^1X^-$$

and wherein $Z^2$ is selected from the group consisting of ester, reverse ester, amide, and reverse amide.

18. The composition according to claim 17 wherein $Z^2$ is $$-\overset{\overset{O}{\|}}{C}-O-.$$

19. The composition according to claim 18 wherein n is 2 and $R^2$ is hydrogen.

20. The composition according to claim 19 wherein a is 0, m is 2, $R^4$ is methylene, t is 1, y is from 1 to 10, and $R^3$ is a $C_8$-$C_{18}$ alkyl group.

21. The composition according to claim 17 wherein the ratio of nonionic surfactant to cationic surfactant is from about 5:3 to about 5:1.

22. The composition according to claim 11 which contains from about 5% to about 20% of said inorganic alkaline component.

23. The composition according to claim 22 wherein said alkaline component is contained in an amount such that the composition forms a solution having a pH of from about 8.5 to about 9.5 within about 2 minutes, when placed in 100° F. water at a concentration of about 0.15%.

24. The composition according to claim 12 which contains from about 5% to about 20% of said inorganic alkaline component.

25. The composition according to claim 24 wherein said alkaline component is included in an amount such that said composition forms a solution having a pH of from about 8.5 to about 9.5, within about 2 minutes, when placed in 100° F. water at a concentration of about 0.15%.

26. The composition according to claim 25 wherein the ratio of said nonionic surfactant to said cationic surfactant is from about 5:3 to about 5:1.

27. The composition according to claim 26 wherein said alkaline component is selected from the group consisting of borax decahydrate, borax pentahydrate, and mixtures thereof.

28. The composition according to claim 27 which contains from about 8% to about 16% of said alkaline component.

29. The composition according to claim 28 wherein, in said cationic component, $R^1$ is $CH_3$, $R^2$ is $C_{17}$ alkyl, and X is a chlorine anion.

30. The composition according to claim 29 wherein the ratio of said nonionic component to said cationic component is about 5:2.

31. The composition according to claim 13 wherein n is 0, a is 0, m is 2, $R^2$ is $C_{17}$ alkyl, $R^1$ is $CH_3$, and X is chlorine anion.

32. A process for laundering fabrics comprising the agitation of said fabrics in an aqueous solution containing from about 0.01 to about 0.3% of the detergent composition of claim 1.

* * * * *